US007251949B2

(12) United States Patent
Yamanaka et al.

(10) Patent No.: US 7,251,949 B2
(45) Date of Patent: Aug. 7, 2007

(54) REFRIGERANT SYSTEM

(75) Inventors: Masaji Yamanaka, Gunma (JP); Shigeya Ishigaki, Gunma (JP); Kenzo Matsumoto, Gunma (JP); Haruhisa Yamasaki, Gunma (JP); Midori Futakawame, Gunma (JP)

(73) Assignee: Sanyo Electric Co., Ltd., Osaka (JP)

( * ) Notice: Subject to any disclaimer, the term of this patent is extended or adjusted under 35 U.S.C. 154(b) by 150 days.

(21) Appl. No.: 11/053,200

(22) Filed: Feb. 8, 2005

(65) Prior Publication Data

US 2005/0217296 A1 Oct. 6, 2005

(30) Foreign Application Priority Data

Feb. 9, 2004 (JP) ..... 2004-032509
Feb. 9, 2004 (JP) ..... 2004-032511

(51) Int. Cl.
*A47F 3/04* (2006.01)

(52) U.S. Cl. ..... 62/255; 62/513

(58) Field of Classification Search ..... 62/246–256, 62/513

See application file for complete search history.

(56) References Cited

U.S. PATENT DOCUMENTS 3,255,599 A 6/1966 Morrison
4,824,454 A 4/1989 Kondo et al.
4,967,564 A 11/1990 Strasser
5,417,079 A 5/1995 Rudick et al.
6,418,735 B1 * 7/2002 Sienel ..... 62/115
2005/0172654 A1 * 8/2005 Rohrer et al. ..... 62/246

FOREIGN PATENT DOCUMENTS

DE 10018169 10/2001
EP 0369827 5/1990
EP 0 928 934 A 7/1999

(Continued)

*Primary Examiner*—William E. Tapolcai
(74) *Attorney, Agent, or Firm*—Weingarten, Schurgin, Gagnebin & Lebovici LLP

(57) ABSTRACT

A refrigerant system 1D comprises a heat insulating housing 3 provided with an accommodating space inside and a refrigeration unit 9 attached to a lower portion of the heat insulating housing 3, in which a compressor 5, a gas cooler 6, an internal heat exchanger 10, a restriction means 16 and an evaporator 8 accommodated in a heat insulating case 7A are disposed on a unit base 4. The gas cooler 6 and the heat insulating case 7A are disposed so that air heat-exchanged by the gas cooler 6 moves toward the heat insulating case 7A, an air passage T is provided between the unit base 4 and the heat insulating case 7A, the air heat-exchanged by the gas cooler 6 is passed through the air passage T to be discharged outside, and the internal heat exchanger 10 is disposed in such a manner that it is embedded in a heat insulating material layer 7C provided around the heat insulating case 7A to be provided with a heat insulation property. Accordingly, exhaust heat-exchanged by the gas cooler is discharged outside without stagnation, and increases in an overload and operation power of the compressor are suppressed and the durability of the compressor can be improved. Further, the heat-exchanging efficiency of the internal heat exchanger can be improved and the generation of condensation on a surface of an outer side tube of the internal heat exchanger can be prevented.

16 Claims, 7 Drawing Sheets

FOREIGN PATENT DOCUMENTS

| | | | |
|---|---|---|---|
| EP | 1 344 938 | A | 9/2003 |
| JP | 58073171 | | 5/1983 |
| JP | 63297983 | | 12/1988 |
| JP | 01111183 | | 4/1989 |
| JP | 01159576 | | 6/1989 |
| JP | 02125199 | | 5/1990 |
| JP | 03-503206 | A | 7/1991 |
| JP | 05052298 | | 3/1993 |
| JP | 08327171 | | 12/1996 |
| JP | 10-019401 | A | 1/1998 |
| JP | 10-096532 | A | 4/1998 |
| JP | 10148450 | A | 6/1998 |
| JP | 10246547 | | 9/1998 |
| JP | 2001 116736 | A | 4/1999 |
| JP | 2003-056969 | A | 2/2003 |
| JP | 2003-065651 | A | 3/2003 |
| WO | WO 09 07683 | | 7/1990 |

* cited by examiner

PRIOR ART

PRIOR ART

REFRIGERANT SYSTEM

This application claims priority to Japanese application No. 2004-032509 filed Feb. 9, 2004, and Japanese application No. 2004-032511 filed Feb. 9, 2004.

BACKGROUND OF THE INVENTION

1. Technical Field

The present invention relates to a refrigerant system applicable to a vending machine, a showcase or the like, and more specifically relates to a refrigerant system comprising a heat insulating housing provided with an accommodating space, and a refrigeration unit, attached to a lower portion of said heat insulating housing and in which a compressor, a gas cooler, an internal heat exchanger, a restriction means and an evaporator are disposed on a unit base.

2. Related Art

FIG. 8 is an explanatory cross-sectional view of one example of a conventional refrigerant system. The conventional refrigerant system 1A (an example of a showcase) comprises a heat insulating housing 3 provided with an accommodating space 2 inside, and a refrigeration unit 9 attached to a lower portion of the heat insulating housing 3, and in which a compressor 5, a gas cooler 6, a restriction means not shown are disposed on a unit base 4, and an evaporator 8 is accommodated in a heat insulating case 7 attached onto the unit base 4, and the compressor 5, the gas cooler 6, the restriction means not shown, and the evaporator 8 are sequentially connected to form a refrigeration circuit (see for example, Japanese Patent Laid-Open Publication No. H10-96532, No. 2003-56969 and No. 2003-65651). In FIG. 8, the reference numeral 17 denotes a fan for the gas cooler 6, the reference numeral 18 denotes a fan for the evaporator 8, the reference numeral 19 denotes a accommodating shelf for accommodating articles and the reference numeral 9A denotes an exhaust outlet.

When the refrigerant system 1A is operated, refrigerant gas compressed and discharged with the compressor 5 flows into the gas cooler 6. Then outside air is introduced by the fan 17 as shown by an arrow and is heat-dissipated by an air-cooling system. The heat-dissipated refrigerant passes through an internal heat exchanger not shown, and the refrigerant gas is heat-lost by a low-pressure side refrigerant to be further cooled. Then the cooled high-pressure side refrigerant gas reaches an expansion valve (restriction means) and the pressure is controlled to lower pressure so that the refrigerant gas has a two-phase mixture of gas/liquid. The mixture flows into the evaporator 8 as it is and the refrigerant is evaporated there to exhibit a cooling action by heat absorption from air. Then cooled air is introduced into the accommodating space 2 of the heat insulating housing 3 by the fan 18 as shown in an arrow (or in the opposite direction to the arrow) and is circulated.

After that the refrigerant flows out of the evaporator 8 and passes through an internal heat exchanger not shown to take heat from the high-pressure side refrigerant while receiving the heating action. Then the obtained refrigerant is perfectly gasified and the gasified refrigerant repeats cycles to be sucked into the compressor 5.

FIG. 9 is an explanatory cross-sectional view of another example of a conventional refrigerant system. The conventional refrigerant system 1E (an example of a showcase) comprises a heat insulating housing 3 provided with an accommodating space 2 inside, and a refrigeration unit 9, attached to a lower portion of the heat insulating housing 3, and in which a compressor 5, a gas cooler 6, a restriction means not shown are disposed on a unit base 4, a plurality of supporting columns 7B is fixedly provided on the unit base 4, a heat insulating case 7 is set on the column supports 7B and an evaporator 8 is accommodated in the heat insulating case 7, and the compressor 5, the gas cooler 6, the internal heat exchanger 10, the restriction means not shown, and the evaporator 8 are sequentially connected to form a refrigeration circuit (see for example, Japanese Patent Laid-Open Publication No. H10-96532, No. 2003-56969 and No. 2003-65651).

In FIG. 9, the reference numeral 17 denotes a fan for the gas cooler 6, the reference numeral 18 denotes a fan for the evaporator 8, the reference numeral 9A denotes an exhaust outlet and the reference numeral 19 denotes a accommodating shelf for accommodating articles.

When the refrigerant system 1E is operated, refrigerant gas compressed and discharged with the compressor 5 flows into the gas cooler 6. Then outside air is introduced by the fan 17 as shown by an arrow (or in the opposite direction to the arrow) and is heat-dissipated by an air-cooling system. The heat-dissipated refrigerant passes through an inner side tube of the internal heat exchanger 10 composed of a, double pipe and refrigerant gas heat exchanges there with a low pressure side refrigerant, which passes through an outer side tube of the internal heat exchanger 10 to be further cooled by being heat lost. Then the cooled high-pressure side refrigerant gas reaches an expansion valve (restriction means) and the pressure is controlled to lower pressure so that the refrigerant gas has a two-phase mixture of gas/liquid. The mixture flows into the evaporator 8 as it is and the refrigerant is evaporated there to exhibit a cooling action by heat absorption from air. Then cooled air is introduced into the accommodating space 2 of the heat insulating housing 3 by the fan 18 as shown in an arrow (or in the opposite direction to the arrow) and is circulated.

After that the refrigerant flows out of the evaporator 8 and passes through the outer side tube of the internal heat exchanger 10 to take heat from the high-pressure side refrigerant, which passes through the inner side tube of the internal heat exchanger 10 while receiving the heating action. Then the obtained refrigerant is perfectly gasified and the gasified refrigerant repeats cycles to be sucked into the compressor 5.

In the refrigeration cycle, fluorocarbon (R11, R12, R134*a* or the like) has been generally used as a refrigerant. However, when fluorocarbon is emitted into the atmosphere it has significant problems of the earth-warming effect, the ozone layer breakage and the like in large scale. Thus a study using other natural refrigerants having small influence on the environment, for example oxygen ($O_2$), carbon dioxide ($CO_2$), hydrocarbon (HC), ammonia ($NH_3$), and water ($H_2O$) as a refrigerant has been performed. Among these natural refrigerants, oxygen and water are low in pressure and it is difficult to use them as refrigerants in refrigeration cycles. Since ammonia and hydrocarbon are flammable, there is a problem that their handling is difficult. Thus a device using a transitional critical refrigerant cycles, to be operated on the high pressure side at super critical pressure, where carbon dioxide ($CO_2$) is used as a refrigerant, has been developed (see Japanese Patent Laid-Open Publication No. H10-19401 and No. No. H07-18602).

However, in the conventional refrigerant system 1A, exhaust heat-exchanged by the gas cooler 6 moves in the direction of the heat insulating case 7, and after running against the heat insulating case 7 the exhaust moves around the heat insulating case 7 to flow toward the rear of the heat insulating case 7 so that it is discharged from the exhaust outlet 9A provided on a rear portion of the refrigeration unit 9 to the outside. Accordingly, airflow of the exhaust heat-exchanged by the gas cooler 6 is blocked by the heat insulating case 7 and airflow stagnates around the gas cooler 6 so that heat does not escape. Thus, air cooling of refrigerant gas in the gas cooler 6 becomes insufficient, resulting in an increase in the operation pressure. As a result the compressor 5 reaches an overload state and problems arise that an operation power is increased, a protection device is actuated to stop the compressor and the durability of the compressor 5 is adversely affected whereby its useful life of is shortened.

Alternatively, in the conventional refrigerant system 1E, exhaust heat-exchanged by the gas cooler 6 moves in the direction of the internal heat exchanger 10, and after running against the heat insulating case 7 and the internal heat exchanger 10, the exhaust moves around the heat insulating case 7 and internal heat exchanger 10 to flow toward the rear of the heat insulating case 7 and internal heat exchanger 10 so that it is discharged from the exhaust outlet 9A provided on a rear portion of the refrigeration unit 9 to the outside. As a result, airflow of the exhaust heat-exchanged by the gas cooler 6 is blocked by the heat insulating case 7 and the internal heat exchanger 10, and airflow stagnates around the gas cooler 6 so that heat does not escape. Thus, air cooling of refrigerant gas in the gas cooler 6 becomes insufficient, resulting in an increase in the operation pressure. As a result the compressor 5 reaches an overload state and problems arise that an operation power is increased, a protection device is actuated to stop the compressor and the durability of the compressor 5 is adversely affected whereby its useful life of is shortened. Further, since exhaust heat-exchanged by the gas cooler 6 flows around the internal heat exchanger 10, there are problems that the heat-exchanging efficiency of the internal heat exchanger 10 is lowered and condensation occurs on a surface of the outer side tube (the low pressure side refrigerant, which flows out of the evaporator 8, flows) of the internal heat exchanger 10.

Further, in a case where carbon dioxide is used as a refrigerant, the refrigerant pressure reaches about 150 kg/cm$^2$ G on the high pressure side. On the other hand, in a refrigeration cycle using carbon dioxide as a refrigerant so that the refrigerant pressure reaches about 30 to 40 kg/cm$^2$ G on the low pressure side, the refrigerant pressure becomes higher and the refrigerant temperature also becomes higher as compared with fluorocarbon. Particularly, when single-stage compressing compressor is used, portions, which adjoin between the high pressure side portion and the low pressure side portion are formed in the respective sliding members. Thus there is a problem that since the differential pressure easily generates sliding loss or leak loss and the refrigerant temperature is increased, the air cooling of the refrigerant gas in the gas cooler becomes more insufficient.

SUMMARY OF THE INVENTION

A first object of the present invention is to solve the above-mentioned conventional problems or to provide a refrigerant system in which exhaust heat-exchanged by a gas cooler is caused to smoothly flow without stagnation, refrigerant gas is sufficiently cooled in the gas cooler, the durability of the compressor can be improved without causing an overload state and an increase in operation power of the compressor, and even if carbon dioxide is used as a refrigerant the generation of the sliding loss and leak loss and an air-cooling shortage of refrigerant gas in the gas cooler can be minimized.

A second object of the present invention is to solve the above-mentioned conventional problems or to provide a refrigerant system in which exhaust heat-exchanged by a gas cooler is caused to smoothly flow without stagnation, refrigerant gas is sufficiently cooled in the gas cooler, the durability of the compressor can be improved without causing an overload state and an increase in operation power of the compressor, and the heat-exchanging efficiency of an internal heat exchanger is improved and at the same time the generation of condensation on a surface of an outer side tube of the internal heat exchanger can be prevented, and even if carbon dioxide is used as a refrigerant the generation of the sliding loss and leak loss and an air-cooling shortage of refrigerant gas in the gas cooler can be minimized.

To solve the above-mentioned problems, a refrigerant system according to first aspect of the invention, comprises a heat insulating housing provided with an accommodating space inside, and a refrigeration unit attached to a lower portion of said heat insulating housing, in which a compressor, a gas cooler, a restriction means and an evaporator accommodated in an insulating case are disposed on a unit base, and a refrigeration circuit is formed by sequentially connecting said compressor, said gas cooler, said restriction means and said evaporator, and the refrigerant system is characterized in that said gas cooler and said insulating case are disposed so that air heat-exchanged by said gas cooler moves toward said heat insulating case, and an air passage is provided between said unit base and said heat insulating case whereby air heat exchanged by said gas cooler is passed through said air passage to be discharged outside.

To solve the above-mentioned problems, a refrigerant system according to second aspect of the present invention, comprises a heat insulating housing provided with an accommodating space inside, and a refrigeration unit attached to a lower portion of said heat insulating housing, in which a compressor, a gas cooler, an internal heat exchanger, a restriction means and an evaporator accommodated in an insulating case are disposed on a unit base, and a refrigeration circuit is formed by sequentially connecting said compressor, said gas cooler, said internal heat exchanger, said restriction means and said evaporator, and the refrigerant system is characterized in that said gas cooler and said insulating case are disposed so that air heat exchanged by said gas cooler moves toward said heat insulating case, and an air passage is provided between said unit base and said heat insulating case whereby air heat-exchanged by said gas cooler is passed through said air passage to be discharged outside, and that said internal heat exchanger and/or said restriction means are provided in such a manner that they are embedded in a heat insulating material layer provided on an outer periphery of said heat insulating case to be provided with a heat insulation property.

In the refrigerant system according to first or second aspect, a refrigerant system according to third aspect of the present invention is characterized in that at least one exhaust passage is provided at a place of said unit base corresponding to a portion of said air passage, through which most of air heat-exchanged by said gas cooler passes to discharge air heat-exchanged by said gas cooler outside through said exhaust passage.

In the refrigerant system according to any one of first to third aspects, a refrigerant system according to fourth aspect of the present invention is characterized in that said refrigeration unit is formed for being detachable and attachable.

In the refrigerant system according to any one of first to fourth aspects, a refrigerant system according to fifth aspect of the present invention is characterized in that carbon dioxide, which exhibits super critical pressure on the high pressure side, is used as a refrigerant and a two-stage compressing rotary compressor is used as said compressor.

Since the refrigerant system according to first aspect of the present invention comprises a heat insulating housing provided with an accommodating space inside, and a refrigeration unit attached to a lower portion of said heat insulating housing, in which a compressor, a gas cooler, a restriction means and an evaporator accommodated in an insulating case are disposed on a unit base, and a refrigeration circuit is formed by sequentially connecting said compressor, said gas cooler, said restriction means and said evaporator, and said gas cooler and said insulating case are disposed so that air heat-exchanged by said gas cooler moves toward said heat insulating case, and an air passage is provided between said unit base and said heat insulating case whereby air heat exchanged by said gas cooler is passed through said air passage to be discharged outside, such remarkable effects that exhaust heat-exchanged by the gas cooler is caused to flow and can be discharged without stagnation of the exhaust, refrigerant gas can be sufficiently cooled in the gas cooler, and that the durability of the compressor can be improved without causing an overload state in the compressor or an increase in operation power, are exhibited.

Further, since the refrigerant system according to second aspect of the present invention comprises a heat insulating housing provided with an accommodating space inside, and a refrigeration unit attached to a lower portion of said heat insulating housing, in which a compressor, a gas cooler, an internal heat exchanger, a restriction means and an evaporator accommodated in an insulating case is disposed on a unit base, and a refrigeration circuit is formed by sequentially connecting said compressor, said gas cooler, said internal heat exchanger, said restriction means and said evaporator, and said gas cooler and insulating case are disposed so that air heat exchanged by said gas cooler moves toward said heat insulating case, and an air passage is provided between said unit base and said heat insulating case whereby air heat-exchanged by said gas cooler is passed through said air passage to be discharged outside, and said internal heat exchanger and/or said restriction means are provided in such a manner that they are embedded in a heat insulating material layer provided on an outer periphery of said heat insulating case to be provided with heat insulation, such remarkable effects that exhaust heat-exchanged by the gas cooler is caused to smoothly flow and can be discharged without stagnation of the exhaust, refrigerant gas can be sufficiently cooled in the gas cooler, the durability of the compressor can be improved without causing an overload state in the compressor or an increase in operation power, the heat-exchanging efficiency of the internal heat exchanger is improved and that the generation of condensation on a surface of an outer side tube of the internal heat exchanger can be prevented and the system can be downsized, are exhibited.

Further, since in the refrigerant system according to first or second aspect, the refrigerant system according to third aspect of the present invention is characterized in that at least one exhaust passage is provided at a place of said unit base corresponding to a portion of said air passage, through which most of air heat-exchanged by said gas cooler passes to discharge air heat-exchanged by said gas cooler outside through said exhaust passage, such a more remarkable effect that exhaust is caused to flow well and can be discharged without stagnation is exhibited.

Further, since in the refrigerant system according to any one of first to third aspects, the refrigerant system according to fourth aspect of the present invention is characterized in that said refrigeration unit is formed removably and the refrigeration unit can be easily attached to or removed from the heat insulating housing, such a more remarkable effect that a refrigeration unit formed in this company is attached to a heat insulating housing formed by another company to assemble and manufacture a refrigerant system of the present invention, or that after a refrigeration unit is removed from the refrigerant system of the present invention and repaired, the refrigeration unit can be attached to the system again to assemble, is exhibited.

Further, since in the refrigerant system according to any one of first to fourth aspects, the refrigerant system according to fifth aspect of the present invention is characterized in that carbon dioxide, which exhibits super critical pressure on the high pressure side, is used as a refrigerant and a two-stage compressing rotary compressor is used as said compressor, in a case where carbon dioxide is used as a refrigerant, the refrigerant pressure reaches even about 130 to 150 kg/cm$^2$ G on the high pressure side and about 30 to 40 kg/cm$^2$ G on the low pressure side. However, since the differential pressure in the respective sliding members becomes about ½ and a surface pressure is lowered so that an oil film is ensured, such a more remarkable effect that the generation of a sliding loss or a leak loss can be minimized.

DETAILED DESCRIPTION OF THE PREFERRED EMBODIMENT

Preferred embodiments of the present invention will be described below in detail with reference to drawings.

First Embodiment

Figure 1:
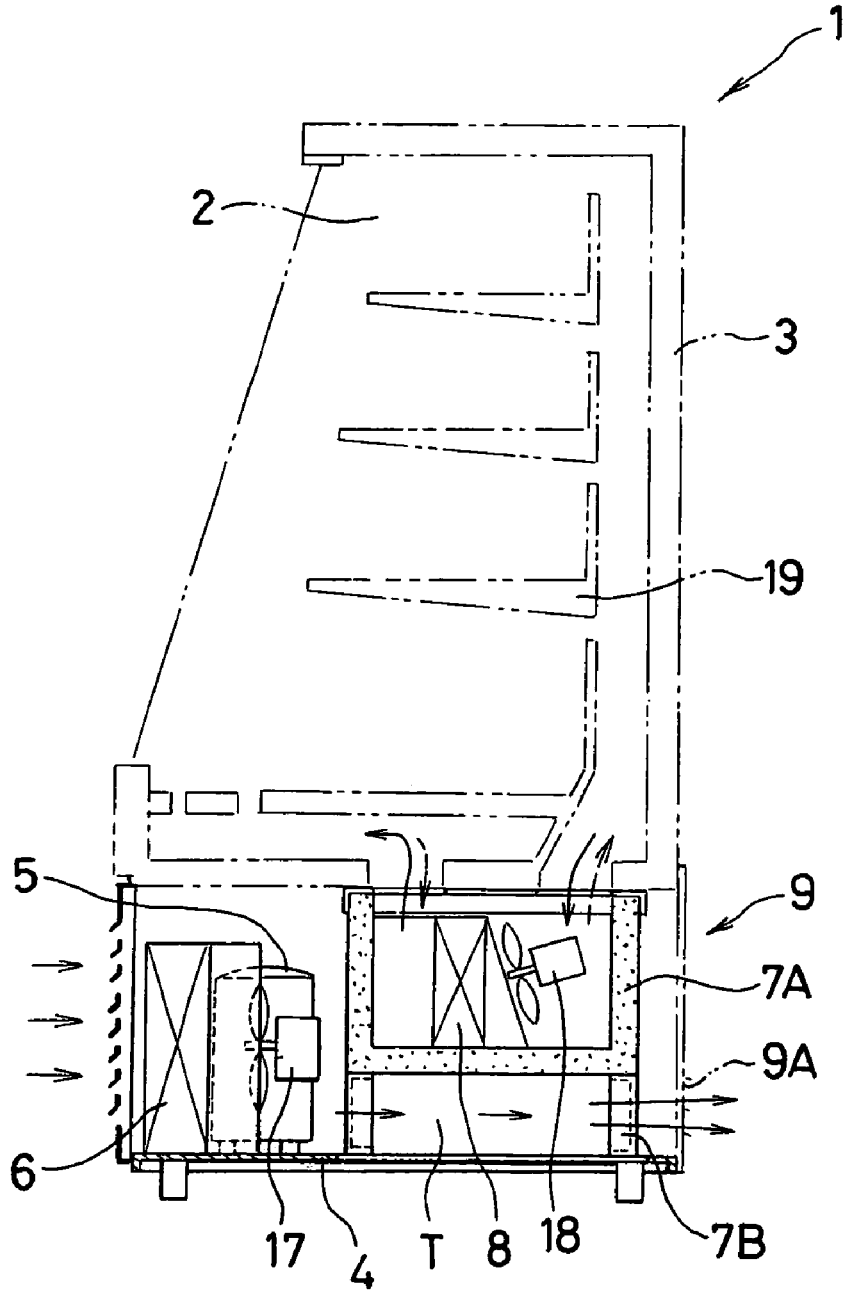
FIG. 1 is an explanatory cross-sectional view explaining one embodiment of a refrigerant system according to the present invention.

FIG. 1 is an explanatory cross-sectional view explaining one embodiment of a refrigerant system according to the present invention.

Figure 2:
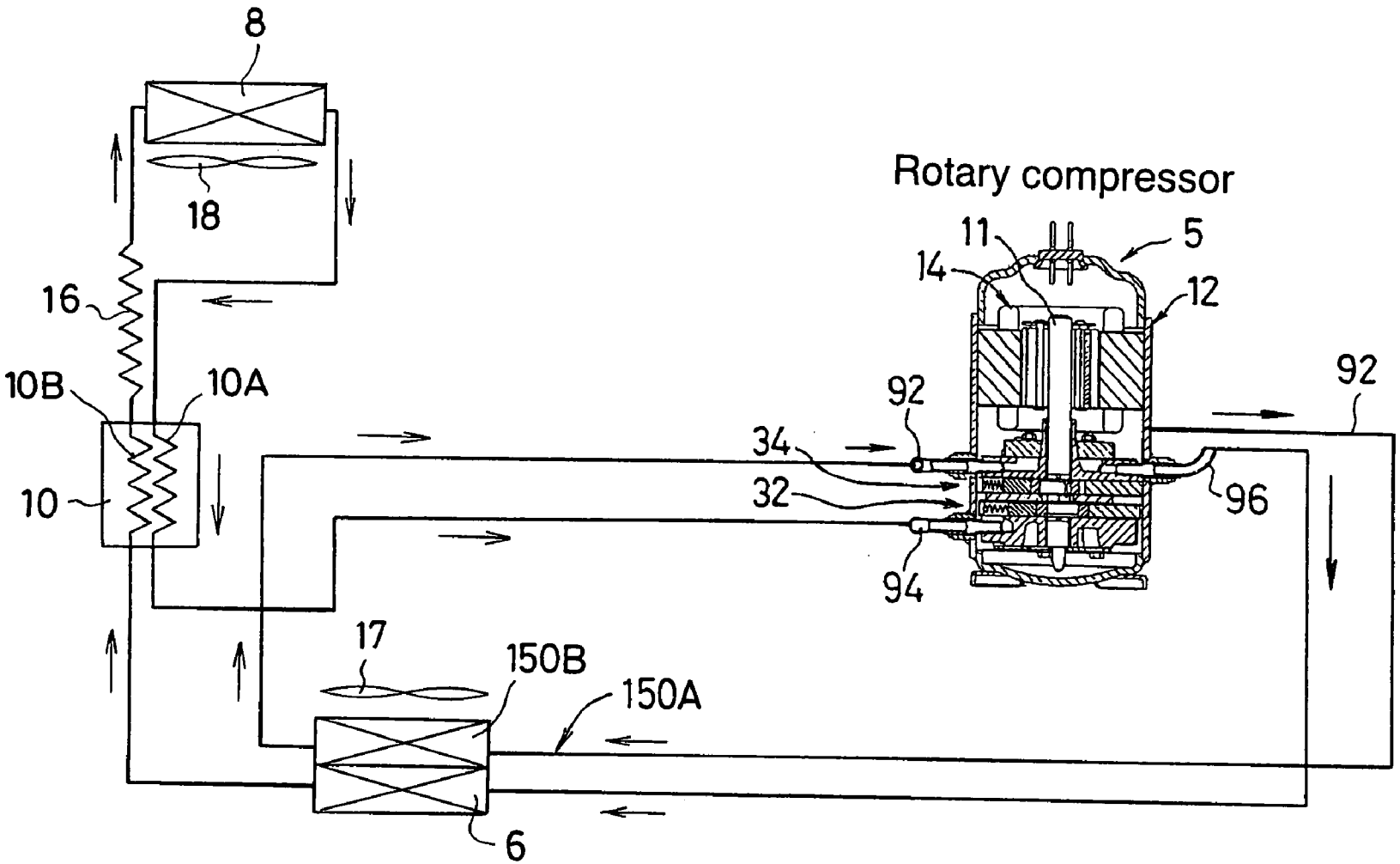
FIG. 2 is a refrigeration circuit of the refrigerant system of the present invention.

FIG. 2 is a refrigeration, circuit of the refrigerant system of the present invention.

Figure 3:
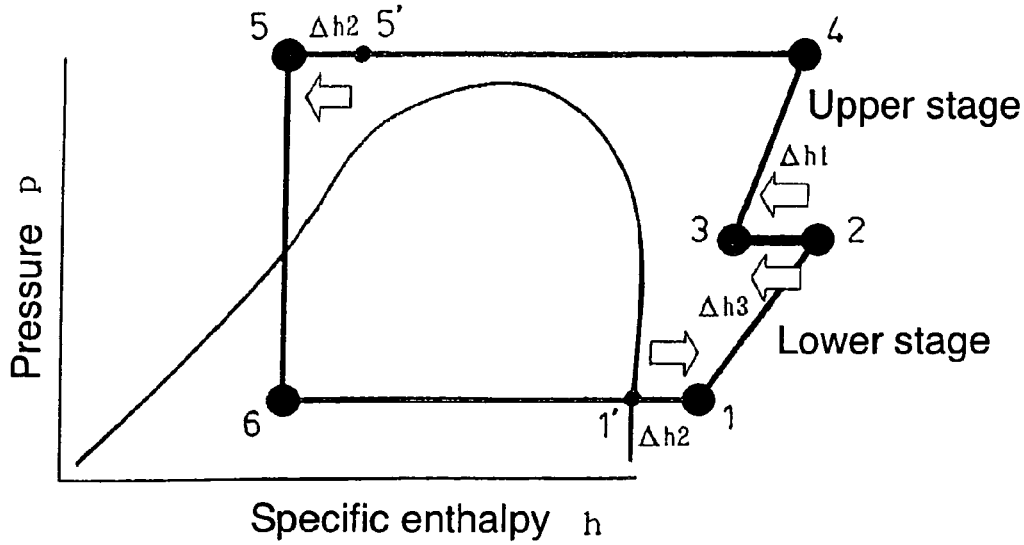
FIG. 3 is p-h diagram of the refrigeration circuit in FIG. 2.

FIG. 3 is a p-h diagram of the refrigeration circuit in FIG. 2.

It is noted that a refrigerant system of the present invention is used in a vending machine, a refrigerator, a showcase or the like.

A refrigerant system 1 (showcase) of the present invention comprises a heat insulating housing 3 provided with an accommodating space 2 inside, and a refrigeration unit 9 attached to a lower portion of the heat insulating housing 3, in which a compressor 5, a gas cooler 6, an internal heat exchanger 10, and a restriction means 16 are disposed on a unit base 4, a plurality of supporting columns 7B are fixedly provided on the unit base 4 at intervals, a heat insulating case 7A is set on the supporting columns 7B, an evaporator 8 accommodated in an insulating case 7A is disposed, and the gas cooler 6 and insulating case 7A are disposed so that exhaust heat-exchanged by the gas cooler 6 moves toward the heat insulating case 7A, and a refrigeration circuit is formed by sequentially connecting said compressor 5, said gas cooler 6, said internal heat exchanger 10, said restriction means 16 and said evaporator 8.

In FIG. 1, the reference numeral 17 denotes a fan for a gas cooler 6, the reference numeral 18 denotes a fan for the evaporator 8, the reference numeral 19 denotes an accommodating shelf for accommodating articles, and the reference numerals 9A denotes an exhaust outlet.

Since a plurality of supporting columns 7B are fixedly provided on the unit base 4 at intervals and the heat insulating case 7A is set on the supporting columns 7B, an air passage T is formed between the unit base 4 and the heat insulating case 7A.

In FIG. 2, the reference numeral 5 denotes an internal intermediate pressure type multi-stage (two stage) compressing rotary compressor, and comprises a motor-drive element 14 in a closed vessel 12, and a lower stage rotary compressing element 32 and an upper stage rotary compressing element 34, driven by a rotating shaft 11 of the motor-drive element 14. The compressor 5 compresses refrigerant gas sucked through a refrigerant introduction pipe 94 with the lower stage rotary compressing element 32 and discharges it into the closed vessel 12. Then intermediate pressure refrigerant gas in the closed vessel 12 is once discharged to an intermediate cooling circuit 150A through a refrigerant introduction pipe 92.

The intermediate cooling circuit 150A is provided so that refrigerant gas passes through an intermediate cooling heat exchanger 150B, and then the refrigerant gas is air-cooled and sucked into the upper stage rotary compressing element 34 through the refrigerant introduction pipe 92. The refrigerant high pressurized by the second stage compression is discharged through a refrigerant discharge pipe 96 and is air-cooled by a gas cooler 6. After refrigerant emitted from the gas cooler 6 was heat-exchanged with refrigerant emitted from an evaporator 8 by an internal heat exchanger 10, it passes through a restriction means 16 and enters the evaporator 8. Then after the refrigerant was evaporated, it passes through the internal heat exchanger 10 again and is sucked into the lower stage rotary compressing element 32 through the refrigerant introduction pipe 94.

The operation in this case will be described with reference to a p-h diagram of FIG. 3. A refrigerant (a state of 2 in FIG. 3) compressed (while obtaining enthalpy Δh3) by the lower stage rotary compressing element 32 to have intermediate pressure and discharged into the closed vessel 12 emits from the refrigerant pipe 92 and flows into the intermediate cooling circuit 150A. Then, the refrigerant flows into an intermediate cooling heat exchanger 150B through which the intermediate cooling circuit passes, and is heat-dissipated dissipated there by an air-cooling system (a state of 3 in FIG. 3). The intermediate pressure refrigerant loses enthalpy Δh1 in the intermediate cooling heat exchanger 150B as shown in FIG. 3.

After that the refrigerant is sucked into the upper stage rotary compressing element 34 and the second stage compression is performed to obtain a high-pressure and temperature refrigerant gas, which is discharged to the outside from the refrigerant discharge pipe 96. At this time the refrigerant is compressed up to an appropriate super critical pressure (a state of 4 in FIG. 3).

The refrigerant gas discharged from the refrigerant discharge pipe 96 flows into the gas cooler 6 and is heat-dissipated there by an air-cooling system (a state of 5' in FIG. 3). After that the refrigerant gas passes through the internal heat exchanger 10. The heat of the refrigerant is taken by a low pressure side refrigerant to be more cooled (a state of 5 in FIG. 3) (enthalpy is lost by Δh2). After that the refrigerant is decompressed by the restriction means 16 while becoming in a gas/liquid mixture state in the process (a state of 6 in FIG. 3), and then flows into the evaporator 8 to be evaporated (a state of 1' in FIG. 3). The refrigerant emitted from the evaporator 8 passes through the internal heat exchanger 10 and takes heat from said high-pressure side refrigerant there to be heated (a state of 1 in FIG. 3) (enthalpy is obtained by Δh2).

Then the refrigerant is heated by the internal heat exchanger 10 and is perfectly gasified. The gasified refrigerant repeats a cycle where it is sucked into the lower stage rotary compressing element 32 of the rotary compressor 5 from the refrigerant introduction pipe 94.

In this embodiment although carbon dioxide was used as a refrigerant, since the internal intermediate pressure type multi-stage (two stage) compressing rotary compressor 5 was used as described above, the differential pressure in the respective sliding members is reduced to about ½, surface pressure is decreased and an oil film of a lubricating oil is sufficiently ensured so that the sliding loss and leak loss can be minimized. Further, the lubricating oil does not reach high temperature of 100° C. or more so that high COP can be obtained.

The refrigerant evaporated by the evaporator 8 exhibits a cooling action by heat absorption from air, and cooled air is introduced into the accommodating space 2 of the heat insulating housing 3 by the fan 18 as shown by the arrow and is circulated.

The exhaust heat-exchanged by the gas cooler 6 passes through the air passage T as shown by the arrow and is discharged to the outside from the exhaust outlet 9A. As a result since exhaust heat-exchanged by the gas cooler 6 is caused to smoothly flow without stagnation and can be discharged and refrigerant gas can be sufficiently cooled in the gas cooler 6, the durability of the compressor 5 can be improved without causing an overload state in the compressor 5 and an increase in operation power.

Second Embodiment

Figure 4:
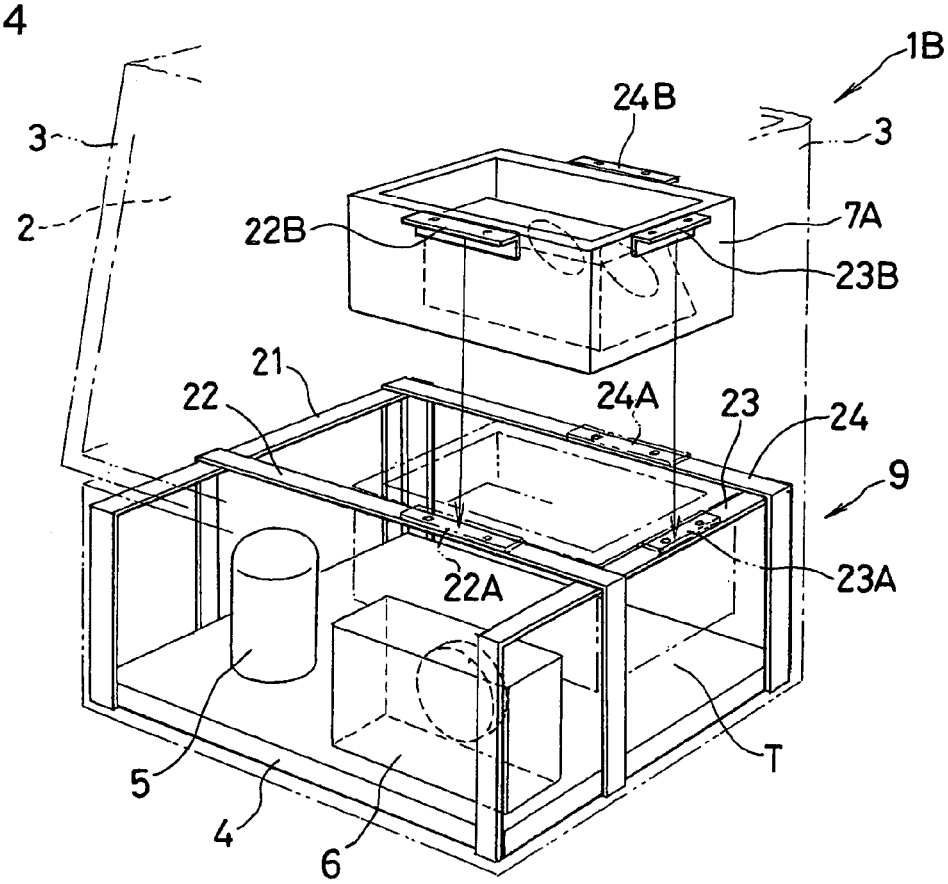
FIG. 4 is an explanatory view explaining a refrigeration unit in another refrigerant system according to the present invention.

FIG. 4 is an explanatory view explaining another refrigerant system according to the present invention.

In a refrigerant system 1B (showcase) shown in FIG. 4 a skeleton of a refrigeration unit 9 is formed by a combination of U-shaped frame members 21, 22, 23 and 24 as shown in FIG. 4, and fixing members 22A, 23A and 24A for fixing a heat insulating case 7A to predetermined positions of the frame members 22, 23 and 24 are provided.

On the other hand, fixing members 22B, 23B and 24B are provided at positions of the heat insulating case 7A corresponding to the fixing members 22A, 23A and 24A.

The fixing members 22B, 23B and 24B of the heat insulating case 7A are made to correspond with the fixing members 22A, 23A and 24A so that the heat insulating case 7A is set on the skeleton of the refrigeration unit 9, and are fixed by screws and the like not shown. The refrigerant system 1B is the same as the refrigerant system 1 of the present invention shown in FIG. 1 except that the air passage T was formed between the unit base 4 and the bottom portion of the heat insulating case 7A as described above.

The refrigerant system 1B of the present invention has the same actions and effects as those of the refrigerant system 1 of the present invention. Additionally, if the heat insulating case 7A is fixed in such a manner it can be easily reliably fixed or can be removed and it is not shifted during operation. Thus reliability is improved.

Third Embodiment

Figure 5:
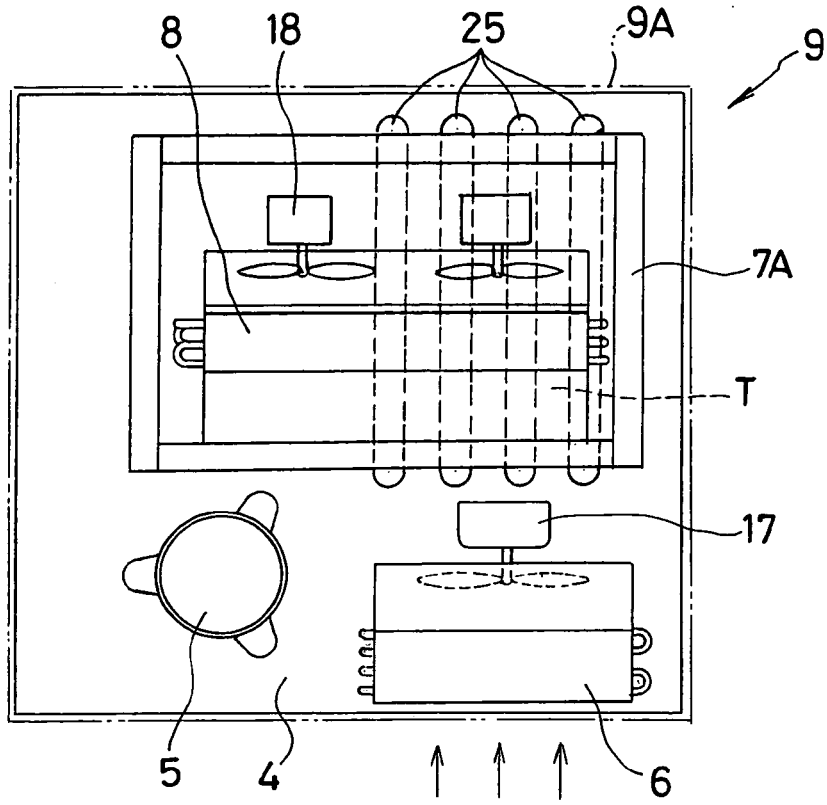
FIG. 5 is an explanatory cross-sectional view explaining another refrigerant system according to the present invention.

FIG. 5 is an explanatory view explaining a refrigeration unit of another refrigerant system according to the present invention.

A refrigeration unit 9 of a refrigerant system of the present invention shown in FIG. 5 is the same as in the refrigerant system 1 of the present invention shown in FIG. 1 except that elongated four exhaust passages 25 are penetratingly provided at positions of the unit base 4 corresponding to the portion of the air passage T through which most of exhaust heat-exchanged by the gas cooler 6 passes and the exhaust heat-exchanged by the gas cooler 6 passes through the exhaust passages 25 to be discharged outside.

The refrigeration unit 9 of the refrigerant system of the present invention has the same actions and effects as the refrigerant system 1 of the present invention. Further the exhaust heat-exchanged by the gas cooler 6 well flows without stagnation and passes through the exhaust passage 25 and exhaust outlet 9A, and can be discharged outside. Accordingly, refrigerant gas can be sufficiently cooled in the gas cooler 6 and the durability of the compressor 5 can be improved without causing an overload state in the compressor 5 and an increase in operation power.

Fourth Embodiment

Figure 6:
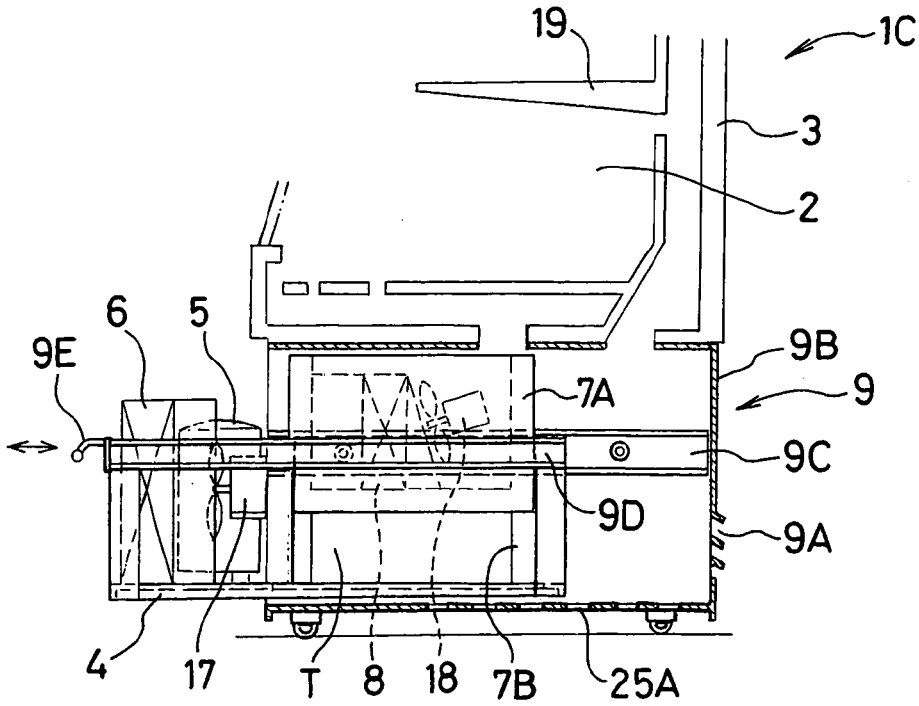
FIG. 6 is an explanatory cross-sectional view explaining another refrigerant system according to the present invention.

FIG. 6 is an explanatory view explaining another refrigerant system according to the present invention.

A refrigerant system (showcase) 1C of the present invention shown in FIG. 6 is the same as the refrigerant systems of the present invention shown in FIGS. 1 and 5 except that the refrigerant system 1C comprises a heat insulating housing 3 provided with an accommodating space 2 inside, and a refrigeration unit 9 fixed to a predetermined position of a lower portion of the heat insulating housing 3, in which a compressor 5, a gas cooler 6, an internal heat exchanger and restriction means not shown, are disposed on a unit base 4 accommodated in a box 9B removably, a plurality of supporting columns 7B are fixedly provided on the unit base 4 at intervals, a heat insulating case 7A is fixed onto the supporting columns 7B, an evaporator 8 is accommodated in the heat insulating case 7A, and the gas cooler 6 and the heat insulating case 7A are disposed so that exhaust heat-exchanged by the gas cooler 6 moves toward the heat insulating case 7A, and a refrigeration circuit is formed by sequentially connecting the compressor 5, the gas cooler 6, the internal heat exchanger and restriction means not shown and the evaporator 8, while including said box 9B, which accommodates the entire refrigeration circuit inside.

Since a plurality of supporting columns 7B are provided on the unit base 4 at intervals and the heat insulating case 7A is fixedly set on the supporting columns 7B, an air passage T is formed between the unit base 4 and the heat insulating case 7A.

The exhaust heat-exchanged by the gas cooler 6 passes through an air passage T and is discharged from an exhaust outlet 9A to the outside and at the same time discharged from an exhaust passage 25 penetratingly provided in the unit base 4 and from an exhaust outlet 25A penetratingly provided at the position of the box 9B corresponding to the exhaust passage 25, to the outside. As a result since exhaust heat-exchanged by the gas cooler 6 is caused to flow without stagnation and can be discharged outside and refrigerant gas can be sufficiently cooled in the gas cooler 6, the durability of the compressor 5 can be improved without causing an overload state in the compressor 5 and an increase in operation power.

The reference numeral 9C denotes a guide rail provided at a predetermined position on an inner side wall in the box 9B, and a guide rail 9D provided on the side of the compressor 5, the gas cooler 6, the heat insulating case 7A and the like disposed on the unit base 4, is slidably accommodated in the guide rail 9C. The reference numeral 9E denotes a handle fixed to the front end of the guide rail 9D.

In the refrigerant system 1C of the present invention when the handle 9E is pulled this side, it can be easily pulled out while placing the compressor 5, the gas cooler 6, the heat insulating case 7A and the like on the unit base 4. After replacing parts and repairing, they are restored and can be attached.

Although not shown, the box 9B can be easily attached to the heat insulating housing 3 or removed therefrom. A refrigeration unit 9 formed in this company is attached to a heat insulating housing 3 formed by other company and assembled to manufacture the refrigerant system 1C of the present invention. Further, after removing the refrigeration unit 9 from the refrigerant system 1C and repaired, the refrigeration unit 9 is attached again and can be reassembled.

In the above explanation, an example in which a refrigerant emitted from the evaporator is passed through the internal heat exchanger and heat-exchanged with the high pressure side refrigerant whereby the refrigerant is perfectly gasified was explained. However, in place of the use of the internal heat exchanger, a receiver tank may be arranged on a lower pressure side between an outlet side of the evaporator and a suction side of the compressor.

Fifth Embodiment

Figure 7:
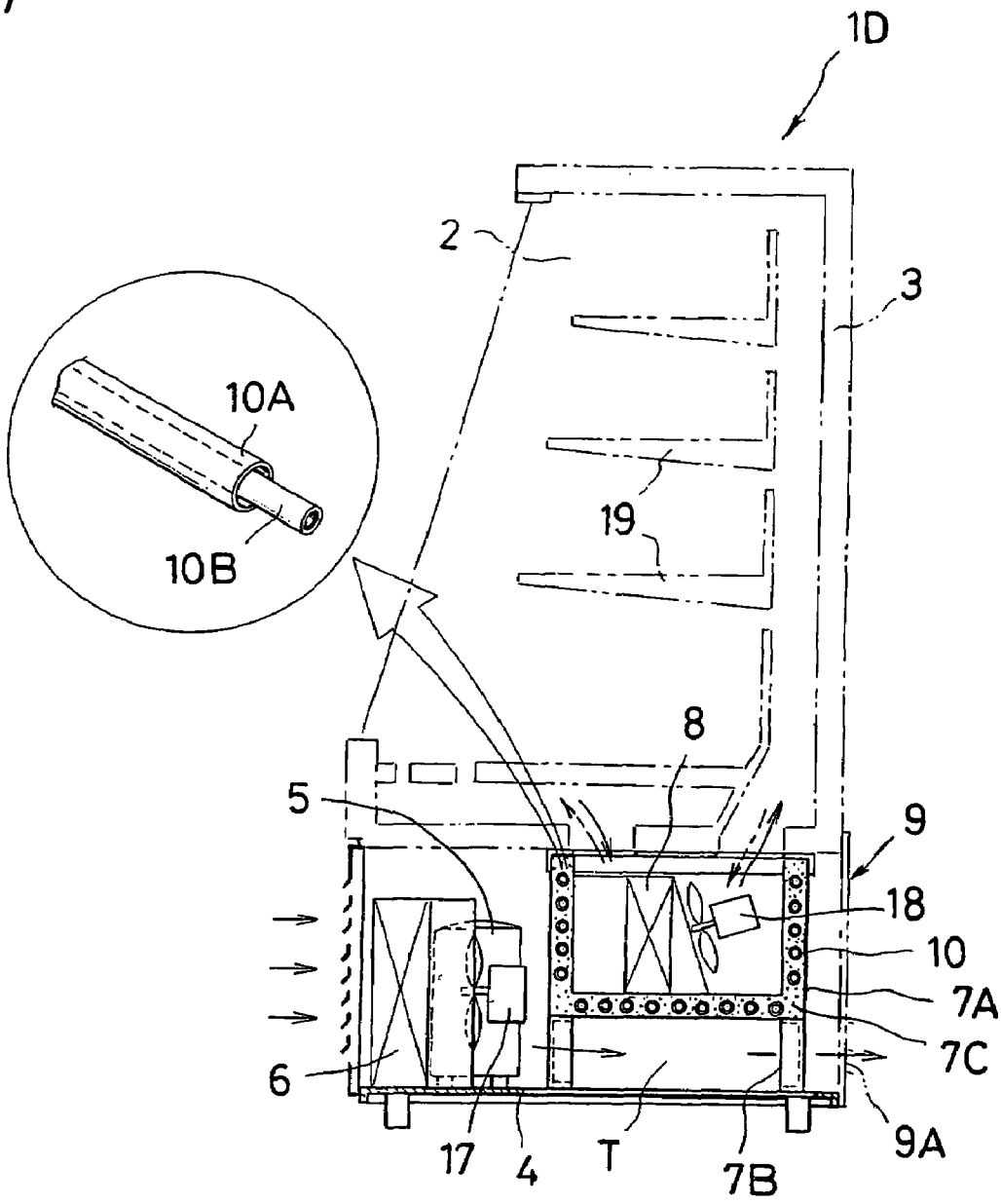
FIG. 7 is an explanatory cross-sectional view explaining another refrigerant system according to the present invention.
Figure 8:
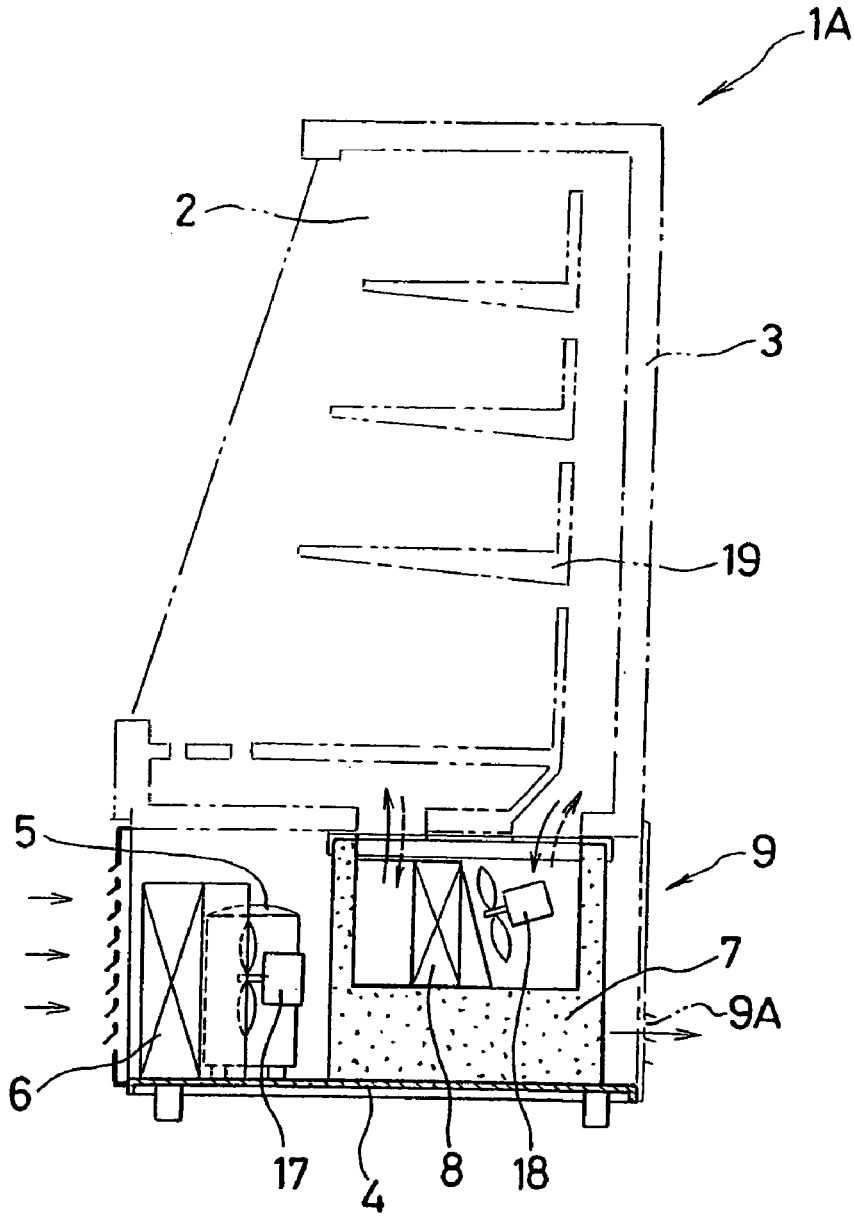
FIG. 8 is an explanatory cross-sectional view explaining an example of a conventional refrigerant system.
Figure 9:
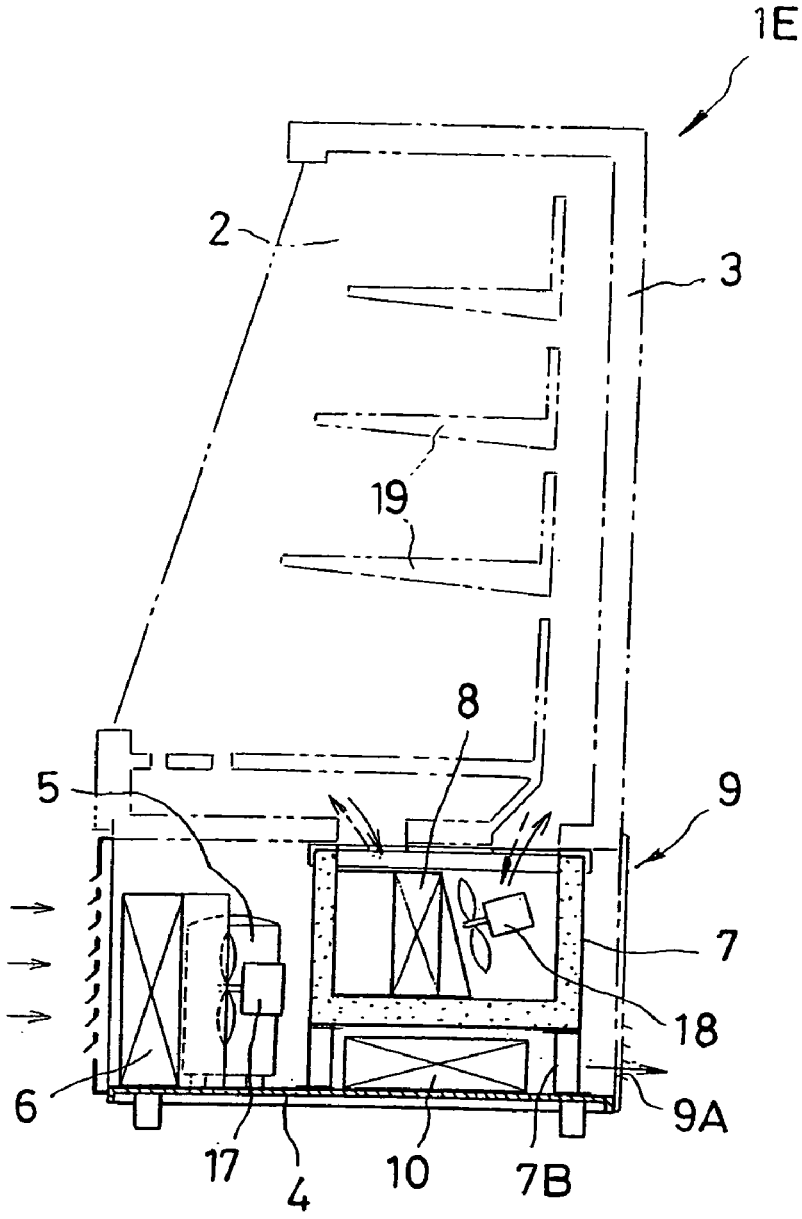
FIG. 9 is an explanatory cross-sectional view explaining another example of a conventional refrigerant system.

FIG. 7 is an explanatory view explaining another refrigerant system of the present invention.

A refrigerant system of the present invention is used in a vending machine, a refrigerator, a showcase or the like.

A refrigerant system 1D (showcase) of the present invention comprises a heat insulating housing 3 provided with an accommodating space 2 inside, and a refrigeration unit 9 attached to a lower portion of the heat insulating housing 3, in which a compressor 5, a gas cooler 6, an internal heat exchanger 10, and a restriction means 16 are disposed on a unit base 4, a plurality of supporting columns 7B are fixedly provided on the unit base 4 at intervals, a heat insulating case 7A is set on the supporting columns 7B, an air passage T is formed between the unit base 4 and the heat insulating 7A, an evaporator 8 accommodated in the heat insulating case 7A is disposed, and the gas cooler 6 and the heat insulating case 7A are disposed so that exhaust heat-exchanged by the gas cooler 6 moves toward the heat insulating case 7A, and a refrigeration circuit is formed by sequentially connecting said compressor 5, said gas cooler 6, said internal heat exchanger 10, said restriction means 16 and said evaporator 8.

The internal heat exchanger 10 is composed of a double pipe consisting of an outer side tube 10A and an inner side tube 10B and is provided for providing the heat insulating case 7A with heat insulation so as to be embedded in a heat insulating material layer 7C provided around the heat insulating case 7A. A refrigerant heat-dissipated by an air cooling system with the gas cooler 6 is passed through the inner side tube 10B of the internal heat exchanger 10 and a low pressure side refrigerant, which flows out of the evaporator 8, is passed through the outer side tube 10A whereby heat exchange is performed.

In FIG. 7, the reference numeral 17 denotes a fan for a gas cooler 6, the reference numeral 18 denotes a fan for the evaporator 8, the reference numerals 9A denotes an exhaust outlet and the reference numeral 19 denotes an accommodating shelf for accommodating articles.

Since a plurality of supporting columns 7B are fixedly provided on the unit base 4 at intervals and the heat insulating case 7A is set on the supporting columns 7B, an air passage T is formed between the unit base 4 and the heat insulating case 7A.

In FIG. 7, the reference numeral 5 denotes an internal intermediate pressure type multi-stage (two stage) compressing rotary compressor as shown in FIG. 2, and comprises a motor-drive element 14 in a closed vessel 12, and a lower stage rotary compressing element 32 and an upper stage rotary compressing element 34, driven by a rotating shaft 11 of the motor-drive element 14. The compressor 5 compresses refrigerant gas sucked through a refrigerant introduction pipe 94 with the lower stage rotary compressing element 32 and discharges it into the closed vessel 12. Then intermediate pressure refrigerant gas in the closed vessel 12 is once discharged to an intermediate cooling circuit 150A through a refrigerant introduction pipe 92.

The intermediate cooling circuit 150A is provided so that refrigerant gas passes through an intermediate cooling heat exchanger 150B, and then the refrigerant gas is air-cooled and sucked into the upper stage rotary compressing element 34 through the refrigerant introduction pipe 92. The refrigerant high pressurized by the second stage compression is discharged through a refrigerant discharge pipe 96 and is cooled by a gas cooler 6. After refrigerant emitted from the gas cooler 6 was heat-exchanged with refrigerant emitted from an evaporator 8 by an internal heat exchanger 10, it passes through a restriction means 16 and enters the evaporator 8. Then after the refrigerant was evaporated, it passes through the internal heat exchanger 10 again and is sucked into the lower stage rotary compressing element 32 through the refrigerant introduction pipe 94.

The operation in this case will be described with reference to a p-h diagram of FIG. 3.

A refrigerant (a state of 2 in FIG. 3) compressed (while obtaining enthalpy Δh3) by the lower stage rotary compressing element 32 to have intermediate pressure and discharged into the closed vessel 12 comes out of the refrigerant introduction pipe 92 and flows into the intermediate cooling circuit 150A. Then, the refrigerant flows into an intermediate cooling heat exchanger 150B through which the intermediate cooling circuit 150A passes, and is heat-dissipated there by an air-cooling system (a state of 3 in FIG. 3). The intermediate pressure refrigerant loses enthalpy Δh1 in the intermediate cooling heat exchanger 150B as shown in FIG. 3.

After that the refrigerant is sucked into the upper stage rotary compressing element 34 and the second stage compression is performed to obtain a high-pressure and temperature refrigerant gas, which is discharged to the outside from the refrigerant discharge pipe 96. At this time the refrigerant is compressed to an appropriate super critical pressure (a state of 4 in FIG. 3).

The refrigerant gas discharged from the refrigerant discharge pipe 96 flows into the gas cooler 6 and is heat-dissipated there by an air-cooling system (a state of 5' in FIG. 3). After that the refrigerant gas passes through the inner side tube 10B of the internal heat exchanger 10. The heat of the refrigerant, which passes through the outer side tube 10A of the internal heat exchanger 10, is taken by a low pressure side refrigerant to be more cooled (a state of 5 in FIG. 3) (enthalpy is lost by Δh2). After that the refrigerant is reduced in the pressure by the restriction means 16 while becoming in a gas/liquid mixture state in the process (a state of 6 in FIG. 3), and then flows into the evaporator 8 to be evaporated (a state of 1' in FIG. 3). The refrigerant emitted from the evaporator 8 passes through the outer side tube 10A of the internal heat exchanger 10 and takes heat from the high-pressure side refrigerant there to be heated (a state of 1 in FIG. 3) (enthalpy is obtained by Δh2).

Then the refrigerant is heated by the internal heat exchanger 10 and is perfectly gasified. The gasified refrigerant repeats a cycle where it is sucked into the lower stage rotary compressing element 32 of the rotary compressor 5 from the refrigerant introduction pipe 94.

In this embodiment although carbon dioxide was used as a refrigerant, since the internal intermediate pressure type multi-stage (two stage) compressing rotary compressor 5 was used as described above, the differential pressure in the respective sliding members is reduced to about ½, surface pressure is decreased and an oil film of a lubricating oil is sufficiently ensured so that the sliding loss and leak loss can be minimized. Further, the lubricating oil does not reach high temperature of 100° C. or more so that high COP can be obtained.

The refrigerant evaporated by the evaporator 8 exhibits a cooling action by heat absorption from air, and cooled air is introduced into the accommodating space 2 of the heat insulating housing 3 by the fan 18 as shown by the arrow and is circulated.

The exhaust heat-exchanged by the gas cooler 6 passes through the air passage T as shown by the arrow and is discharged to the outside from the exhaust outlet 9A. As a result since exhaust heat-exchanged by the gas cooler 6 is caused to smoothly flow without stagnation and can be discharged and refrigerant gas can be sufficiently cooled in the gas cooler 6, the durability of the compressor 5 can be improved without causing an overload state in the compressor 5 and an increase in operation power.

Since the internal heat exchanger 10 is arranged in such a manner that it is embedded in a heat insulating material layer 7C formed of closed-cell polyurethane or the like provided in outer periphery of the heat insulating case 7A to be provided with a heat insulating property, the heat exchanging efficiency of the internal heat exchanger 10 can be improved and at the same time the generation of condensation on a surface of the outer side tube 10A of the internal heat exchanger 10 can be prevented.

Sixth Embodiment

Although a refrigerant system of the sixth embodiment according to the present invention is not shown, the refrigerant system has the same features as the refrigerant system 1D of the present invention shown in FIG. 7 except that a refrigeration unit 9 is the same as the refrigeration unit 9 of the refrigerant system according to the present invention shown in FIG. 5.

Namely, in the refrigeration unit 9 in the refrigerant system of the sixth embodiment of the present invention, elongated four exhaust passages 25 are penetratingly provided at positions of the unit base 4 corresponding to the portion of the air passage T through which most of exhaust heat-exchanged by the gas cooler 6 passes and the exhaust heat-exchanged by the gas cooler 6 passes through the exhaust passages 25 to be discharged outside, as shown in FIG. 5.

The refrigeration unit 9 of the refrigerant system of the sixth embodiment in the present invention has the same actions and effects as the case of the refrigerant system 1D of the present invention. Further the exhaust heat-exchanged by the gas cooler 6 well flows without stagnation and passes through the exhaust passage T and the exhaust outlet 9A, and can be discharged outside. Accordingly, refrigerant gas can be sufficiently cooled in the gas cooler 6 and the durability of the compressor 5 can be improved without causing an overload state in the compressor 5 and an increase in operation power.

Seventh Embodiment

Although a refrigerant system of the seventh embodiment according to the present invention is not shown, the refrigerant system has the same features as the refrigerant system 1D of the present invention shown in FIG. 7 except that the refrigerant system has the same features as the refrigerant system 1C of the present invention shown in FIG. 6.

Namely, the refrigerant system of the seventh embodiment of the present invention is the same as the refrigerant system 1D of the present invention shown in FIG. 7 except that the refrigerant system comprises a heat insulating housing 3 provided with an accommodating space 2 inside, and a refrigeration unit 9 fixed to a predetermined position of a lower portion of the heat insulating housing 3, in which a compressor 5, a gas cooler 6, an internal heat exchanger and restriction means not shown, are disposed on a unit base 4 accommodated in a box 9B removably, a plurality of supporting columns 7B are fixedly provided on the unit base 4 at intervals, a heat insulating case 7A is fixed onto the supporting columns 7B, an evaporator 8 is accommodated in the heat insulating case 7A, and the gas cooler 6 and the heat insulating case 7A are disposed so that exhaust heat-exchanged by the gas cooler 6 moves toward the heat insulating case 7A, and a refrigeration circuit is formed by sequentially connecting the compressor 5, the gas cooler 6, the internal heat exchanger and restriction means not shown and the evaporator 8, while including said box 9B, which accommodates the entire refrigeration circuit inside, as in the refrigerant system (showcase) 1C of the present invention shown in FIG. 6.

Since a plurality of supporting columns 7B are provided on the unit base 4 at intervals and the heat insulating case 7A is fixedly set on the supporting columns 7B, an air passage T is formed between the unit base 4 and the heat insulating case 7A.

The exhaust heat-exchanged by the gas cooler 6 passes through an air passage T and is discharged from an exhaust outlet 9A to the outside and at the same time discharged from an exhaust passage 25 penetratingly provided in the unit base 4 and from an exhaust outlet 25A penetratingly provided at the position of the box 9B corresponding to the exhaust passage 25, to the outside. As a result since exhaust heat-exchanged by the gas cooler 6 is caused to smoothly flow without stagnation and can be discharged outside, refrigerant gas can be sufficiently cooled in the gas cooler 6, the durability of the compressor 5 can be improved without causing an overload state in the compressor 5 and an increase in operation power.

The reference numeral 9C denotes a guide rail provided at a predetermined position on an inner side wall in the box 9B, and a guide rail 9D provided on the side of the compressor 5, the gas cooler 6, the heat insulating case 7A and the like disposed on the unit base 4, is slidably accommodated in the guide rail 9*c*. The reference numeral 9E denotes a handle fixed to the front end of the guide rail 9D.

In the refrigerant system of the seventh embodiment of the present invention when the handle 9E is pulled this side, it can be easily pulled while placing the compressor 5, the gas cooler 6, the heat insulating case 7A and the like on the unit base 4. After replacing parts and repairing, they are restored and can be reattached.

Although not shown, the box 9B can be easily attached to the heat insulating housing 3 or removed therefrom. A refrigeration unit 9 formed in this company is attached to a heat insulating housing 3 formed by other company and assembled to manufacture the refrigerant system of the seventh embodiment in the present invention. Further, after removing the refrigeration unit 9 from the refrigerant system of the seventh embodiment in the present invention and repaired, the refrigeration unit 9 is attached again and can be reassembled.

The descriptions of the above-mentioned embodiments explain the present invention, and do not limit the invention described in claims or narrow the scope of claims. Further, the respective features are not limited to the embodiments, and can be variously modified as follows within a technical scope described in claims.

In the above descriptions, the two-stage compressing rotary compressors have been explained. However, the present invention does not limit the type of a compressor particularly. Specifically, a reciprocating compressor, a vibratory compressor, a multivane rotary compressor, a scroll compressor and the like may be used. Further, the compression stage may have at least one or more.

The refrigerant system of the present invention exhibits such remarkable effects that exhaust heat-exchanged by the gas cooler is caused to flow well without stagnation and can be discharged outside, refrigerant gas can be sufficiently cooled in the gas cooler, and the durability of the compressor can be improved without causing an overload state in the compressor and an increase in operation power and that the heat-exchanging efficiency of the internal heat exchanger can be improved, the generation of condensation on a surface of an outer side tube of the internal heat exchanger can be prevented and the refrigerant system can be downsized. Thus the present invention has high industrial applicability.

What is claimed is:

1. A refrigerant system comprising:

a heat insulating housing provided with an accommodating space inside, and a refrigeration unit attached to a lower portion of said heat insulating housing, wherein a compressor, a restriction means, an evaporator accommodated in an insulation case, and an internal heat exchanger placed within a wall of the insulating case are disposed on a unit base, and a refrigeration circuit is formed by sequentially connecting said compressor, said gas cooler, said internal heat exchanger, said restriction means and said evaporator, wherein said gas cooler and said insulating case are disposed so that air heat-exchanged by said gas cooler moves toward said heat insulating case, and an air passage is provided between said unit base and said heat insulating case by a plurality of supporting columns on the unit base at intervals and on which the heat insulating case is set whereby air heat exchanged by said gas cooler is passed through said air passage to be discharged outside.

2. A refrigerant system comprising a heat insulating housing provided with an accommodating space inside, and a refrigeration unit attached to a lower portion of said heat insulating housing, wherein a compressor, a gas cooler, an internal heat exchanger, a restriction means and an evaporator accommodated in an insulating case are disposed on a unit base, and a refrigeration circuit is formed by sequentially connecting said compressor, said gas cooler, said internal heat exchanger, said restriction means and said evaporator, wherein said gas cooler and insulating case are disposed so that air heat-exchanged by said gas cooler moves toward said heat insulating case, and an air passage is provided between said unit base and said heat insulating case whereby air heat-exchanged by said gas cooler is passed through said air passage to be discharged outside, and said internal heat exchanger and or said restriction means are provided in such a manner that they are embedded in a heat insulating material layer provided on an outer periphery of said heat insulating case for providing a heat insulation property.

3. A refrigerant system according to claim 1, wherein at least one exhaust passage is provided at a place of said unit base corresponding to a portion of said air passage, through which most of air heat-exchanged by said gas cooler and the air heat-exchanged by said gas cooler is passed through said exhaust passage to be discharged outside.

4. A refrigerant system according to claim 1, wherein said refrigeration unit is formed for being detachable and attachable.

5. A refrigerant system according to claim 1, wherein carbon dioxide, which exhibits super critical pressure on the high pressure side, is used as a refrigerant and a two-stage compressing rotary compressor is used as said compressor.

6. A refrigerant system according to claim 2, wherein at least one exhaust passage is provided at a place of said unit base corresponding to a portion of said air passage, through which most of air heat-exchanged by said gas cooler and the air heat-exchanged by said gas cooler is passed through said exhaust passage to be discharged outside.

7. A refrigerant system according to claim 2, wherein said refrigeration unit is formed for being detachable and attachable.

8. A refrigerant system according to claim 3, wherein said refrigeration unit is formed for being detachable and attachable.

9. A refrigerant system according to claim 6, wherein said refrigeration unit is formed for being detachable and attachable.

10. A refrigerant system according to claim 2, wherein carbon dioxide, which exhibits super critical pressure on the high pressure side, is used as a refrigerant and a two-stage compressing rotary compressor is used as said compressor.

11. A refrigerant system according to claim 3, wherein carbon dioxide, which exhibits super critical pressure on the high pressure side, is used as a refrigerant and a two-stage compressing rotary compressor is used as said compressor.

12. A refrigerant system according to claim 4, wherein carbon dioxide, which exhibits super critical pressure on the high pressure side, is used as a refrigerant and a two-stage compressing rotary compressor is used as said compressor.

13. A refrigerant system according to claim 6, wherein carbon dioxide, which exhibits super critical pressure on the high pressure side, is used as a refrigerant and a two-stage compressing rotary compressor is used as said compressor.

14. A refrigerant system according to claim 7, wherein carbon dioxide, which exhibits super critical pressure on the high pressure side, is used as a refrigerant and a two-stage compressing rotary compressor is used as said compressor.

15. A refrigerant system according to claim 8, wherein carbon dioxide, which exhibits super critical pressure, on the high pressure side, is used as a refrigerant and a two-stage compressing rotary compressor is used as said compressor.

16. A refrigerant system according to claim 9, wherein carbon dioxide, which exhibits super critical pressure on the high pressure side, is used as a refrigerant and a two-stage compressing rotary compressor is used as said compressor.

* * * * *

UNITED STATES PATENT AND TRADEMARK OFFICE

CERTIFICATE OF CORRECTION

PATENT NO. : 7,251,949 B2
APPLICATION NO. : 11/053200
DATED : August 7, 2007
INVENTOR(S) : Masaji Yamanaka et al.

It is certified that error appears in the above-identified patent and that said Letters Patent is hereby corrected as shown below:

Column 8, line 2, delete the word "dissipated".

Signed and Sealed this

Twenty-eighth Day of October, 2008

JON W. DUDAS
*Director of the United States Patent and Trademark Office*